US005865002A

United States Patent [19]

Tapojärvi et al.

[11] Patent Number: 5,865,002

[45] Date of Patent: Feb. 2, 1999

[54] JOINT ARRANGEMENT IN CONNECTION WITH A WOOD ELEMENT BLANK

[76] Inventors: Eero Tapojärvi; Sanna Tapojärvi, both of Perttiläntie 14, FIN-08500, Lohja as.; Minna Tapojärvi, Hämeenkatu 4 A 16, FIN-20500, Turku, all of Finland

[21] Appl. No.: 817,447

[22] PCT Filed: Oct. 31, 1995

[86] PCT No.: PCT/FI95/00600

§ 371 Date: Jun. 16, 1997

§ 102(e) Date: Jun. 16, 1997

[87] PCT Pub. No.: WO96/13361

PCT Pub. Date: May 9, 1996

[30] Foreign Application Priority Data

Nov. 1, 1994 [FI] Finland ..... 945150

[51] Int. Cl.[6] ..... B27B 1/00; B27M 3/00

[52] U.S. Cl. ..... 52/313; 52/730.7; 156/264; 144/346; 428/58; 428/106; 428/535; 428/537.1

[58] Field of Search ..... 428/50, 58, 106, 428/114, 535, 537.1; 144/332, 345, 346, 350; 52/730.7, 574, 311.2, 313; 156/264, 512

[56] References Cited

U.S. PATENT DOCUMENTS

| | | | |
|---|---|---|---|
| 3,853,679 | 12/1974 | Ierenzoni | 161/56 |
| 3,961,654 | 6/1976 | Hasenwinkle | 144/316 |
| 4,122,878 | 10/1978 | Kohn | 144/316 |
| 4,301,202 | 11/1981 | Kohn | 428/50 |
| 4,731,145 | 3/1988 | Senzani | 156/264 |
| 5,486,393 | 1/1996 | Wiklund | 428/58 |
| 5,560,409 | 10/1996 | Knorr | 144/350 |

FOREIGN PATENT DOCUMENTS

| | | |
|---|---|---|
| 290153 | 3/1915 | Germany . |
| 641101 | 1/1937 | Germany . |
| 692987 | 6/1940 | Germany . |
| 3216669 | 5/1982 | Germany . |
| 4212687 | 10/1993 | Germany . |
| 8702626 | 9/1991 | Sweden . |
| 8904747 | 6/1989 | WIPO . |
| 9409955 | 5/1994 | WIPO . |

*Primary Examiner*—Robert Canfield
*Attorney, Agent, or Firm*—Ladas & Parry

[57] ABSTRACT

The invention relates to a joint arrangement in connection with the manufacture of a wood element blank, especially a wood board blank or a wood beam blank, in which arrangement the wood element blank is arranged to be formed of several blank battens (1–4) that are arranged to be interconnected with an adhesive, whereupon each blank batten (1–4) is formed to have at least partly substantially triangular cross section, so that it may rest on at least four adjacent blank battens, and that the apex of the triangular part of each blank batten (1–4) remains inside the wood element blank. In order to improve the yield and the strength properties, each blank batten (1–4) is formed with substantially radial cleavings, so that the pith of the wood remains at the apex of the triangular part of the blank batten.

2 Claims, 2 Drawing Sheets

Figure 5:
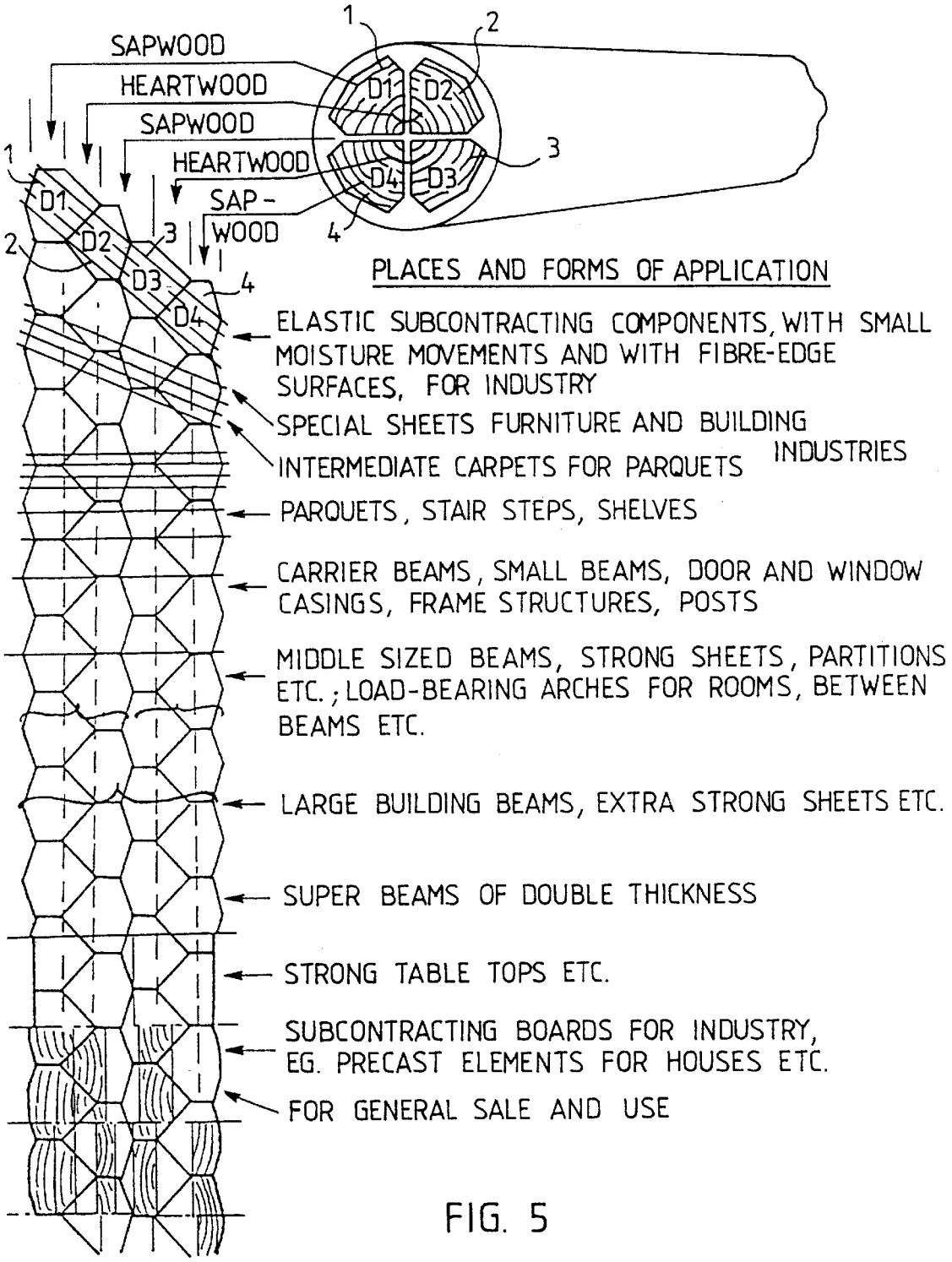

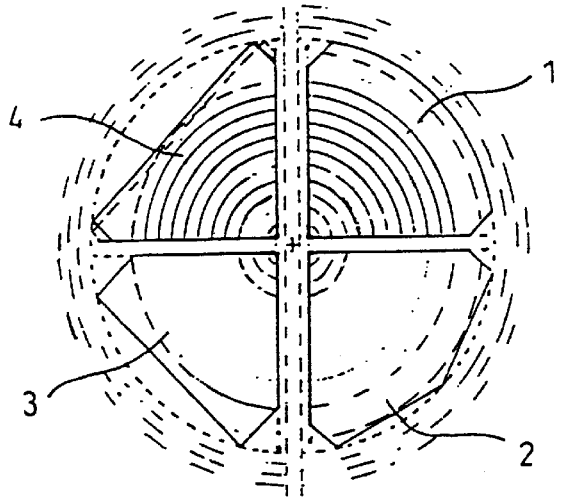
FIG. 1
FIG. 2
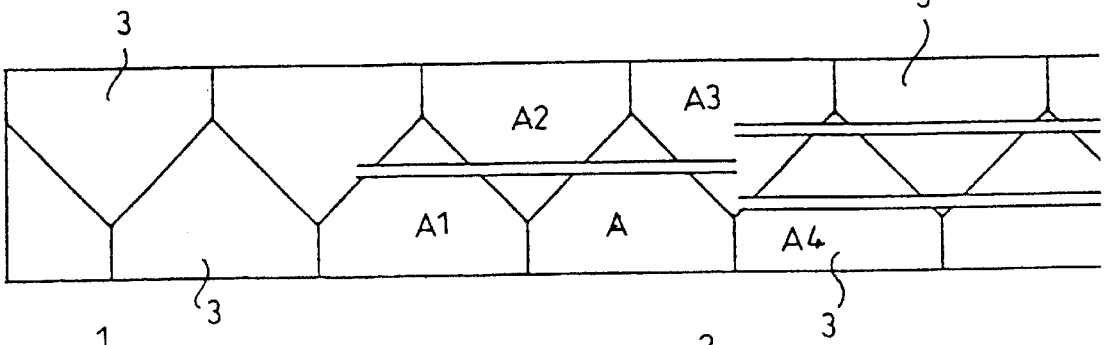
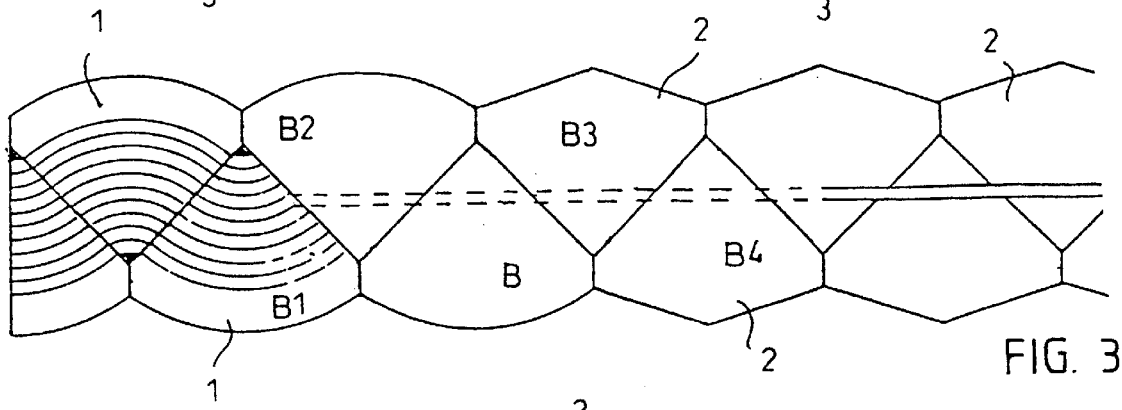
FIG. 3
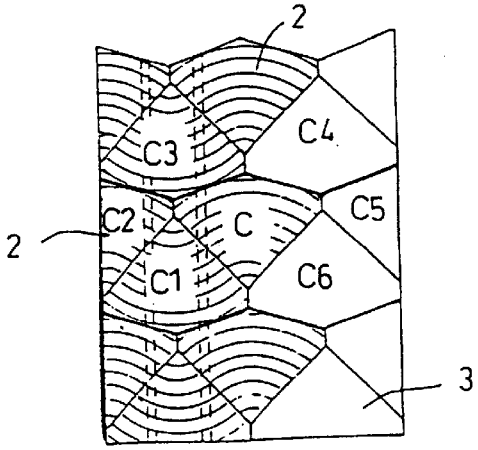
FIG. 4

JOINT ARRANGEMENT IN CONNECTION WITH A WOOD ELEMENT BLANK

The invention relates to a joint arrangement in connection with the manufacture of a wood element blank, especially a wood board blank or a wood beam blank, in which arrangement the wood element blank is arranged to be formed of several blank battens that are arranged to be interconnected with an adhesive, whereupon each blank batten is formed to have at least partly substantially triangular cross-section, so that it may rest on at least four adjacent blank battens, and that the apex of the triangular part of each blank batten remains inside the wood element blank.

Such wood element blanks are at present very well known in different fields of technology. However, the previously known wood boards have often been manufactured in such a way that each blank batten only rests on two adjacent blank battens. The problem of such a board is, however, that for example its strength and processing properties are not the best possible. Another drawback is that the pith of the wood will often be on the surface of the board, wherefore the end product is not the best possible aesthetically. A further drawback of the prior art is that it has not always been exactly simple to provide for example curved surfaces. Examples of such arrangements are described in the PCT patent application WO 89/04747 and in European Patent Application 0 027 488.

Board arrangements wherein each blank batten rests on more than two adjacent blank battens have also been developed in the field. An example of such arrangements is disclosed in German Patent 290 153. One of the drawbacks of this known arrangement is that the pith of the wood will be on the surface of the board. Another disadvantage is the unfavourable orientation of the wood fibres. This drawback leads to problems with strength, since wood stretches and contracts in different ways in the direction of the fibres and perpendicularly to the fibres.

The purpose of the invention is to provide a joint arrangement by means of which the prior art drawbacks can be eliminated. This is achieved with the joint arrangement according to the invention, characterized in that each blank batten is formed with substantially radial cleavings, so that the pith of the wood remains at the apex of the triangular part of the blank batten.

An advantage of the invention is for example that the cracking tension or warping tension are not significantly transferred to the board or beam.

Therefore, the arrangement is applicable in almost all timber species. Another advantage of the invention is that the knots will be positioned at such an angle to the surface that is as advantageous as possible, i.e. perpendicularly to the surface. The aforementioned feature is highly advantageous with respect to the appearance and the processing. Furthermore, the pith of the wood will never be on the surface, because if it is not completely removed during the processing it will remain inside the board. Another advantage is that each blank batten rests on several other battens, wherefore the end product will be highly advantageous, for example either straight, curved or twisted in a controlled manner, as well as uniform in quality and more elastic in every direction than previously. The board surfaces are systematically formed from the best part of the wood, and the direction of the fibres is highly advantageous with respect to stress. Additional strength is provided by a straight and diagonal plain joint that is about 20% wider than in the previous arrangements. Another advantage of the invention is that it is easy to implement, whereupon the production line will be simple, rational, effective and inexpensive. Another factor contributing to faster and easier manufacture is that each blank batten fits in its place only the right way round.

The arrangement according to the invention can be applied both in manual and automated manufacture of boards or beams. A further advantage of the invention is its considerably higher yield compared to the prior art. Another advantage is the possibility of utilizing a considerably wide variety of raw materials, i.e. all kinds of timber from stacked timber to logs is suitable for raw material. A further advantage is that the blank according to the invention can be used in the production of several different products, i.e. the invention is highly versatile in practice.

In the following, the invention will be described in greater detail by means of preferred embodiments shown in the accompanying drawings, in which FIG. 1 shows an advantageous example of manufacturing blank battens, FIG. 2 shows a first board blank embodiment provided by means of the joint arrangement according to the invention, FIG. 3 shows a second board blank embodiment provided by means of the joint arrangement according to the invention, FIG. 4 shows a preferred beam blank embodiment provided by means of the joint arrangement according to the invention, and FIG. 5 shows in principle examples of the kind of products that can be produced from the wood element blank according to the invention.

FIG. 1 shows an example of how the blank battens to be used in the joint arrangement according to the invention can be manufactured. As FIG. 1 shows, blank battens can be advantageously prepared for example from round small-dimension timber. FIG. 1 shows four different blank battens, denoted with reference numerals 1 to 4. The different blank battens 1 to 4 are only shown as examples of typical cross-sectional shapes. It is clear that for example four similar blank battens can also be manufactured from the wood.

As FIG. 1 shows, the yield increases substantially with respect to the prior art. As flexible blank elements, the blank battens 1 to 4 can be reasonably curved, wherefore sawing and planing waste will be minimal with a technique utilizing a small blade.

An essential feature of the invention is that each blank batten 1, 2, 3 or 4 in the board or beam is designed in such a way that it may rest on at least four adjacent blank battens. Each blank batten 1 to 4 is designed in such a way that at least part of the cross-section of the blank batten has a substantially triangular shape. The aforementioned triangular shape is provided by cutting, for example sawing, the wood radially so that the pith of the wood will be at the apex of the triangle. This is clearly visible in FIG. 1. Tensions in the wood are eliminated by means of radial cleaving in the best possible manner, wherefore cracking or twisting do not occur in a finished board or beam blank under normal uniform moisture conditions. The edge surfaces of the blank batten, formed by means of the aforementioned cleaving, are arranged together with the edge surfaces of the adjacent blank battens to form straight and diagonal adhesive surfaces, which means that the adhesive surfaces are both perpendicular to and at an angle to the outer surfaces of the board blank or beam blank, as will be shown below.

FIG. 2 shows an example of a wood board blank manufactured with the Joint arrangement according to the invention. The embodiment of FIG. 2 utilizes the blank battens denoted with reference numeral 3 in FIG. 1. The blank batten which has a partly triangular cross-section, i.e. which is wedge-shaped, is highly applicable in both automatic and manual manufacture of a board or beam blank. Each blank batten can be fitted in place only in the correct position, and each batten settles easily and tightly against each of its joints. The spreading of the adhesive on the blank battens constitutes fully conventional technology for a person skilled in the art, wherefore it will not be described in greater detail here. The straight and diagonal plain joints between the blank battens are clearly visible in FIG. 2. When FIGS. 1 and 2 are compared, it can be seen that the pith of the wood is never on the surface of the board, since it is either removed during the processing or it remains at the apex of the triangle inside the board. Therefore the board will always have a first-class surface, thus providing an advantageous final product.

FIG. 3 shows a second preferred embodiment of the board blank. This embodiment utilizes the blank battens denoted with reference numerals 1 and 2 in FIG. 1. The embodiment of FIG. 3 corresponds substantially to the embodiment of FIG. 2. The example of FIG. 3 only shows that in addition to an even surface, the joint arrangement according to the invention also provides for example embossed surfaces.

FIGS. 2 and 3 show that each blank batten 1, 2 or 3 in the board embodiment is arranged to rest on four adjacent blank battens. The aforementioned feature is shown in FIG. 2 by denoting one blank batten with reference A. The blank batten A rests on four adjacent battens, denoted with references A1, A2, A3 and A4. The result is a very strong structure wherein the plain joint is about 20% larger than in the prior art. A corresponding situation is shown in FIG. 3 by means of blank batten B and the adjacent blank battens B1, B2, B3 and B4.

FIGS. 2 and 3 also illustrate, by means of lines, the principle of how for example board blanks can be cut to produce a desired result. The small beams and components required in the construction industry, beginning from door and window casings, are provided by cleaving a board of suitable thickness, shape and length.

FIG. 4 shows an example of a beam blank formed by means of the joint arrangement according to the invention. The blank according to FIG. 4 is produced from the blank battens denoted with reference numerals 2 and 3 in FIG. 1

Exactly the same features concern the beam blank as the board blank described above. In the case of a beam blank, each blank batten is arranged to rest on six adjacent blank battens. This is shown in FIG. 4 by means of a blank batten denoted by reference C. The blank batten C rests on six adjacent blank battens C1, C2, C3, C4, C5 and C6. Large beams and all boards with fibre-edge surfaces are sawn off beam blanks formed in the aforementioned manner. This is shown in FIG. 4 with dashed lines. Due to for example small lateral moisture-induced movements, boards with fibre-edge surfaces are useful as bottom plates in concrete and felt roofing and as intermediate carpets, made of spruce, in parquet industry, among other things. In the aforementioned manner, the frame parts of spiral stairs and banisters can also be manufactured much better that with the conventional technique. This is due to the fact that as it has been stated above, the final product is the best that can be produced from wood, i.e. either straight, curved or twisted in a controlled manner, as well as uniform in quality in every direction. The directions of the fibres are in practice the kind that have been found to be the most advantageous, and when the product is strained, the fibres act as tension and compression elements.

FIG. 5 shows in principle the kind of products that can be manufactured from the wood element blank according to the invention. FIG. 5 shows small-dimension timber with a round cross-section, the blank battens D1, D2, D3 and D4 having been cut from this timber by means of the principle of FIG. 1. The blank battens D1 to D4 thus correspond in principle to the blank battens 1 to 4 in FIG. 1. FIG. 5 also shows the location of the quality layers of wood, i.e. heartwood and sapwood, in blank battens and in a finished wood element blank.

The wood element blank according to the invention can be produced by adding and compressing to the edge always four blank battens D1 to D4 at a time. This provides the blank according to FIG. 5. It should be noted that in principle the blank can be manufactured in any size. It should also be noted that if the adhesive of the central joint in the blank of FIG. 5 is left out, two thinner board blanks are provided in a simpler manner. An example of the dimensions is that utilizing round timber thicknesses with a diameter of 8 to 10 cm provides basic board thicknesses of 3 to 22 cm. Cleaving the basic board in the manner of FIG. 5 provides general and special-purpose boards, designed according to the needs of the customer, with the best possible fibre structure and wood quality for the required purpose. The quality of the surfaces, i.e. sapwood or heartwood, as well as their colour and shape can also be selected advantageously.

The places and forms of application mentioned in FIG. 5 are only examples of the different possibilities of applying the invention.

The embodiments disclosed above are not intended to limit the invention in any way, but the invention can be modified quite freely within the scope of the claims. Therefore it is clear that the joint arrangement according to the invention or its details do not necessarily have to be exactly like those shown in the figures, but other kinds of arrangements are also possible. The shape of the blank battens does not have to correspond exactly to that shown in the figures, but the wedge-shaped part can be sharper or more obtuse depending on the needs of each situation. The dimensions may also vary quite freely, as well as for example the shapes of the part remaining on the surface of the board. In addition to straight pieces, curved pieces can also be formed of the boards and beams. For example the manufacture of arch-like board elements is quite possible. Correspondingly, curved or twisted beams and other similar parts may be manufactured. It is also possible to prepare, by means of the invention, boards with several layers, for example two-layer boards. In addition to round small-dimension timber, the blank battens can also be prepared from some other wood material, for example the residual peeler cores of the veneer industry. It should also be noted that when blank battens are produced for example according to FIG. 1, it is possible that the four blank battens to be manufactured simultaneously can be made directly into a one-layer or two-layer board or beam, depending on the manner of piling.

We claim:

1. In a wood element blank formed of several blank battens that are interconnected with an adhesive, the improvement comprising:

blank battens formed to have a substantially triangular cross-section part, and to have surfaces of contact with at least four adjacent blank battens; and wherein said blank battens are formed with substantially radial cleavings, so that the pith of the wood remains at an apex of the triangular cross-section part inside the wood element blank.

2. A wood element blank according to claim 1, wherein the surfaces of contact form straight and diagonal plain joints with surfaces of the adjacent blank battens.

* * * * *